US007789495B2

(12) United States Patent
Matsumoto et al.

(10) Patent No.: US 7,789,495 B2
(45) Date of Patent: Sep. 7, 2010

(54) LIQUID EJECTION HEAD AND LIQUID EJECTION APPARATUS

(75) Inventors: Yasuyuki Matsumoto, Azumino (JP); Tetsushi Takahashi, Shimosuwa-cho (JP); Akira Matsuzawa, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 642 days.

(21) Appl. No.: 11/831,757

(22) Filed: Jul. 31, 2007

(65) Prior Publication Data

US 2008/0030552 A1 Feb. 7, 2008

(30) Foreign Application Priority Data

Aug. 2, 2006 (JP) ..... 2006-211484

(51) Int. Cl.
*B41J 2/045* (2006.01)

(52) U.S. Cl. ..... 347/70

(58) Field of Classification Search ..... 347/70, 347/68–69, 71–72
See application file for complete search history.

(56) References Cited

U.S. PATENT DOCUMENTS 6,923,528 B2 * 8/2005 Shimada ..... 347/68
7,641,324 B2 * 1/2010 Shimada ..... 347/70
7,695,120 B2 * 4/2010 Yasoshima ..... 347/71

FOREIGN PATENT DOCUMENTS

JP 07-178909 7/1995
JP 2005-153243 6/2005

* cited by examiner

*Primary Examiner*—K. Feggins
(74) *Attorney, Agent, or Firm*—Workman Nydegger

(57) ABSTRACT

A liquid ejection head including: a flow-channel forming substrate having a pressure generating chamber which communicates with a liquid supply channel which communicates with one end of the pressure generating chamber in terms of a first direction so as to have a first length for supplying liquid to the pressure generating chamber; and a pressure generating unit that causes the change in pressure in the pressure generating chamber, wherein the liquid supply channel is formed by narrowing the width of the pressure generating chamber in a second direction substantially perpendicular to the first direction so as to have a second length shorter than the first length, a stepped surface is formed between the side surface of the pressure generating chamber in the second direction and the side surface of the liquid supply channel in the second direction, and wherein a bridge is provided at a corner defined by the stepped surface, the side surface of the pressure generating chamber in the second direction on the stepped surface side, and one of the surfaces of the pressure generating chamber in a third direction which is orthogonal to the first direction and the second direction of the flow-channel forming substrate for bridging the corner.

7 Claims, 6 Drawing Sheets

LIQUID EJECTION HEAD AND LIQUID EJECTION APPARATUS

The entire disclosure of Japanese Patent Application No. 2006-211464, filed Aug. 2, 2006 expressly incorporated by reference herein.

BACKGROUND

1. Technical Field

The present invention relates to a liquid ejection head and a liquid ejection apparatus for injecting liquid and, more specifically, to an ink jet type recording head and an ink jet type recording apparatus for discharging ink as the liquid.

2. Related Art

Various types of ink jet type recording heads, which correspond to a liquid ejection head generally used in printers, facsimile machines, copying machines and so on are known according to the mechanism for discharging ink drops. For example, there are a type in which ink drops are discharged from nozzle openings by employing a diaphragm as part of a pressure generating chamber which communicates with the nozzle openings and expanding and contracting the capacity of the pressure generating chamber by deforming the diaphragm by displacing a piezoelectric element, and a type in which ink drops are discharged from nozzle openings by changing the capacity of a pressure generating chamber by deforming a diaphragm using electrostatic force.

There is an ink jet type recording head in which a piezoelectric element is provided on one side of a flow-channel forming substrate which is provided with the pressure generating chamber in communication with the nozzle openings in an area which opposes the pressure generating chamber via the diaphragm. The flow-channel forming substrate is formed with an ink supply channel which communicates with one end side of the pressure generating chamber in terms of the longitudinal direction by reducing the width of the pressure generating chamber in the short side direction thereof and an inclined surface formed by inclining a stepped surface between the pressure generating chamber and the ink supply channel in the direction of the thickness of the flow-channel forming substrate (for example, see JP-A-2005-153243 (pp. 7-10, FIG. 2).

However, even though the stepped surface between the pressure generating chamber and the ink supply channel is formed into the inclined surface as disclosed in JP-A-2005-153243, there remains a problem such that air bubbles entering ink supplied from the side of the ink supply channel may stay at a corner defined by the stepped surface and a side surface of the pressure generating chamber, and when the air bubbles are grown up, the interior capacity of the pressure generating chamber is reduced, so that the ink discharging property may be adversely affected.

There is also proposed a configuration in which the corner of the ink supply channel for supplying the ink to the pressure generating chamber is formed into a curved surface along a crystal axis (for example, see JP-A-7-178909 (p. 3, p. 5, FIG. 8 and FIG. 16).

However, with the configuration in JP-A-7-178909, there remains a problem such that air bubbles entering the ink flowing through the ink supply channel cannot be prevented from staying therein.

SUMMARY

An advantage of some aspects of the invention is to provide a liquid ejection head and a liquid ejection apparatus in which the liquid injecting property is improved by preventing air bubbles from staying in a flow channel.

A first aspect of the invention is a liquid ejection head including: a flow-channel forming substrate having a pressure generating chamber which communicates with nozzle openings for injecting liquid and a liquid supply channel which communicates with one end of the pressure generating chamber in terms of a first direction so as to have a first length for supplying liquid to the pressure generating chamber; and pressure generating means for causing the change in pressure in the pressure generating chamber, wherein the liquid supply channel is formed by narrowing the width of the pressure generating chamber in a second direction substantially perpendicular to the first direction so as to have a second length shorter than the first length, a stepped surface is formed between the side surface of the pressure generating chamber in the second direction and the side surface of the liquid supply channel in the second direction, and wherein a bridge is provided at a corner defined by the stepped surface, the side surface of the pressure generating chamber in the second direction on the stepped surface side, and one of the surfaces of the pressure generating chamber in a third direction which is orthogonal to the first direction and the second direction of the flow-channel forming substrate for bridging the corner and is comprised of the same material as the flow-channel forming substrate.

In this configuration, with the provision of the bridge, air bubbles entering liquid supplied from the liquid supply channel to the pressure generating chamber are prevented from staying at the corner of the pressure generating chamber on the liquid supply channel side, and hence the interior capacity of the pressure generating chamber is prevented from changing due to the stayed air bubbles which are grown up, so that the liquid injecting property may be improved.

Preferably, the surface of the bridge is an inclined surface inclined with respect to the stepped surface, the side surface of the pressure generating chamber in the second direction on the stepped surface side, and one of the surfaces of the pressure generating chamber in the third direction of the flow-channel forming substrate.

In this configuration, the air babbles are prevented from staying at the corner defined by the bridge, the stepped surface, the side surface of the pressure generating chamber in second direction on the stepped surface side, and the one of the surfaces of the pressure generating chamber in the third direction of the flow-channel forming substrate.

Preferably, the flow-channel forming substrate is provided with a communication channel having a width larger than that of the liquid supply channel in a second direction at the end of the liquid supply channel on the opposite side from the pressure generating chamber, a stepped surface is provided between the communicating portion and the liquid supply channel, the bridge is provided at a corner defined by the stepped surface, the inner surface of the communication channel in the second direction on the stepped surface side, and one of the surfaces of the communication channel in the third direction of the flow-channel forming substrate for bridging the corner.

In this configuration, with the provision of the bridge at the corner of the communication channel on the liquid supply channel side, air bubbles are prevented from staying at the corner of the communication channel on the liquid supply channel side and the internal capacity of the communication channel from changing due to the stayed air bubbles, so that the liquid injecting property may be improved.

Preferably, the pressure generating means includes a piezoelectric element provided on the flow-channel forming substrate on the one of the surfaces thereof via a diaphragm, and the one of the surfaces of the pressure generating chamber in the flow-channel forming substrate is defined by the diaphragm.

In this configuration, a liquid ejection head superior in the liquid injecting property is achieved by the employment of the piezoelectric element.

Preferably, the stepped surface is formed vertically with respect to the one of the surfaces of the flow-channel forming substrate.

In this configuration, even with the stepped surface which is liable to cause the air bubbles to stay at the corner of the pressure generating chamber on the stepped surface side, air bubbles may be prevented from staying by the bridge.

Preferably, the stepped surface is formed of an inclined surface inclined with respect to the third direction of the flow-channel forming substrate.

In this configuration, even with the stepped surface which hinders easy stay of air bubbles at the corner of the pressure generating chamber on the stepped surface side, the stay of the air bubbles may be reliably prevented by the bridge.

According to a second aspect of the invention, there is provided a liquid ejection apparatus having the liquid ejection head according the first aspect of the invention.

In this configuration, the liquid ejection apparatus in which the liquid injecting property is improved is achieved.

BRIEF DESCRIPTION OF THE DRAWINGS

The invention will be described with reference to the accompanying drawings, wherein like numbers reference like elements.

DESCRIPTION OF EXEMPLARY EMBODIMENTS

Embodiments of the invention will be described in detail below.

First Embodiment

Figure 1:
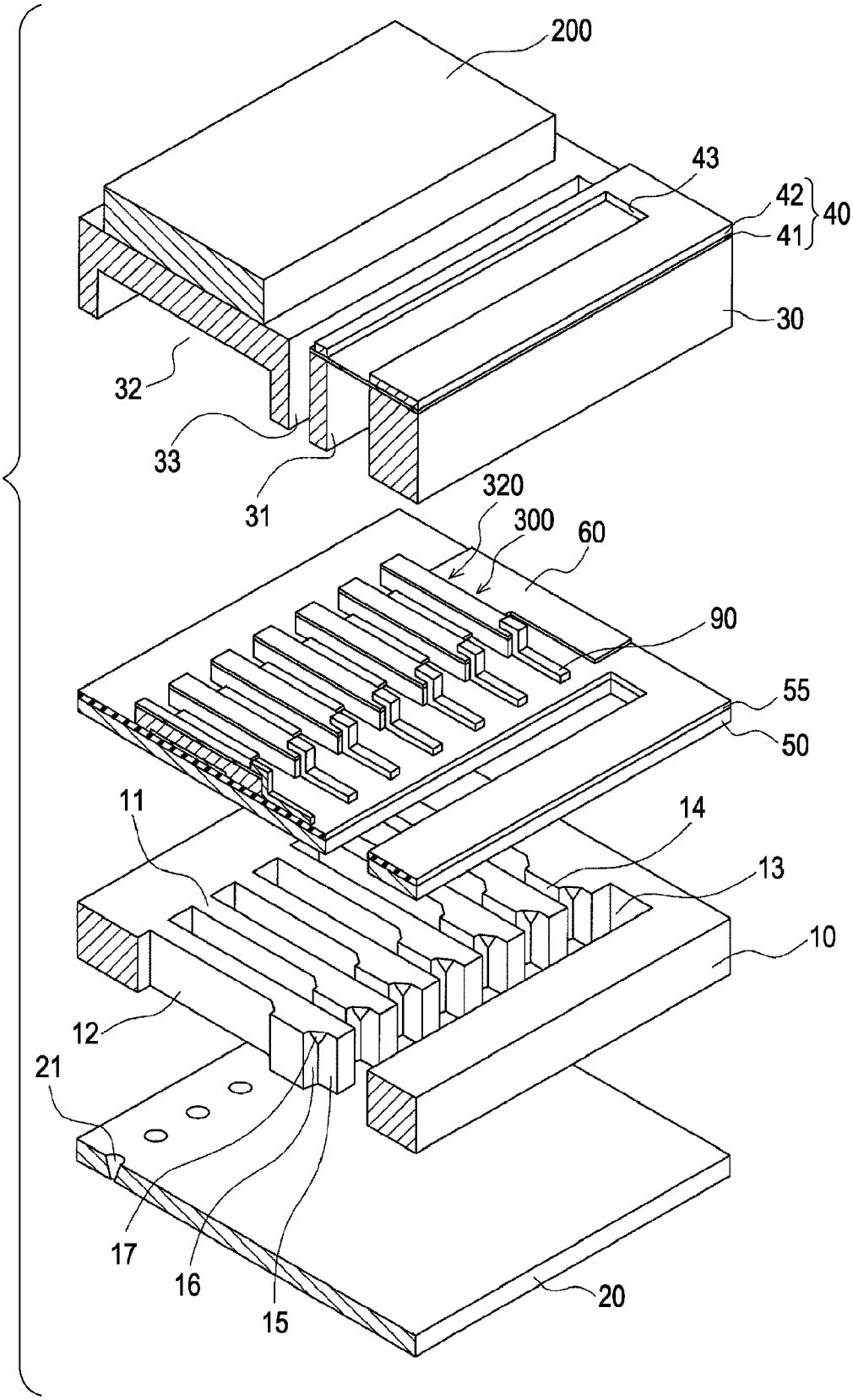
FIG. 1 is an exploded perspective view of a recording head according to a first embodiment.
Figure 2A:
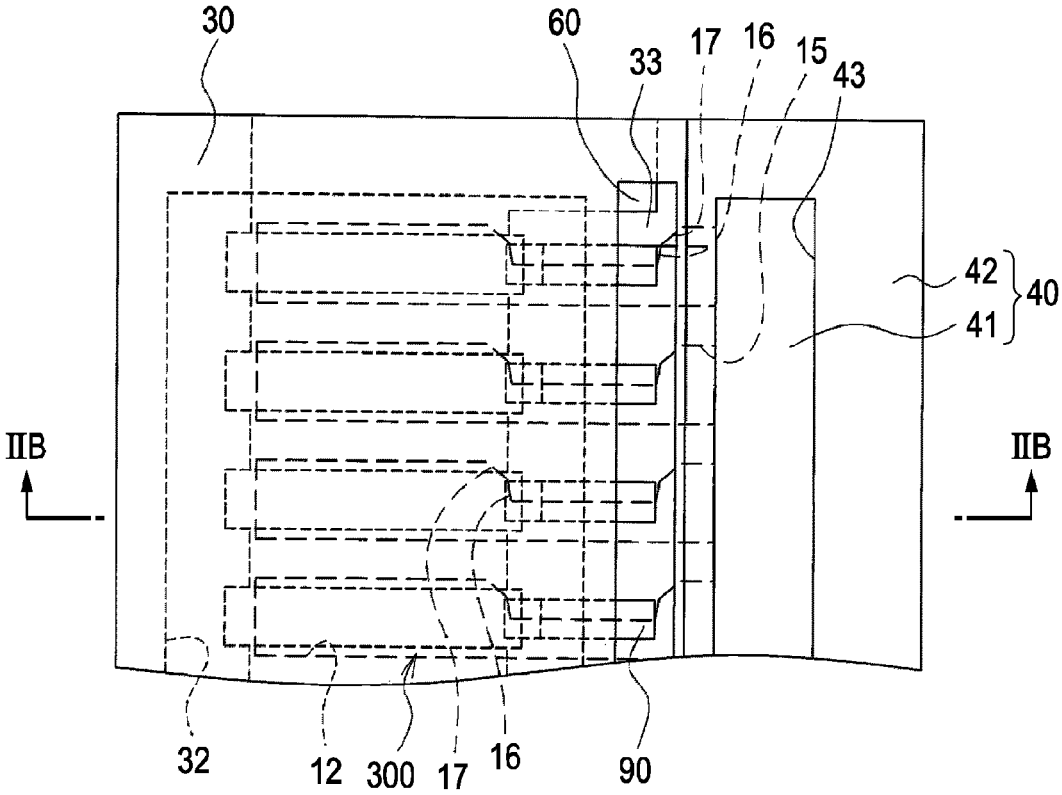
FIG. 2A is a plan view of FIG. 1.
Figure 2B:
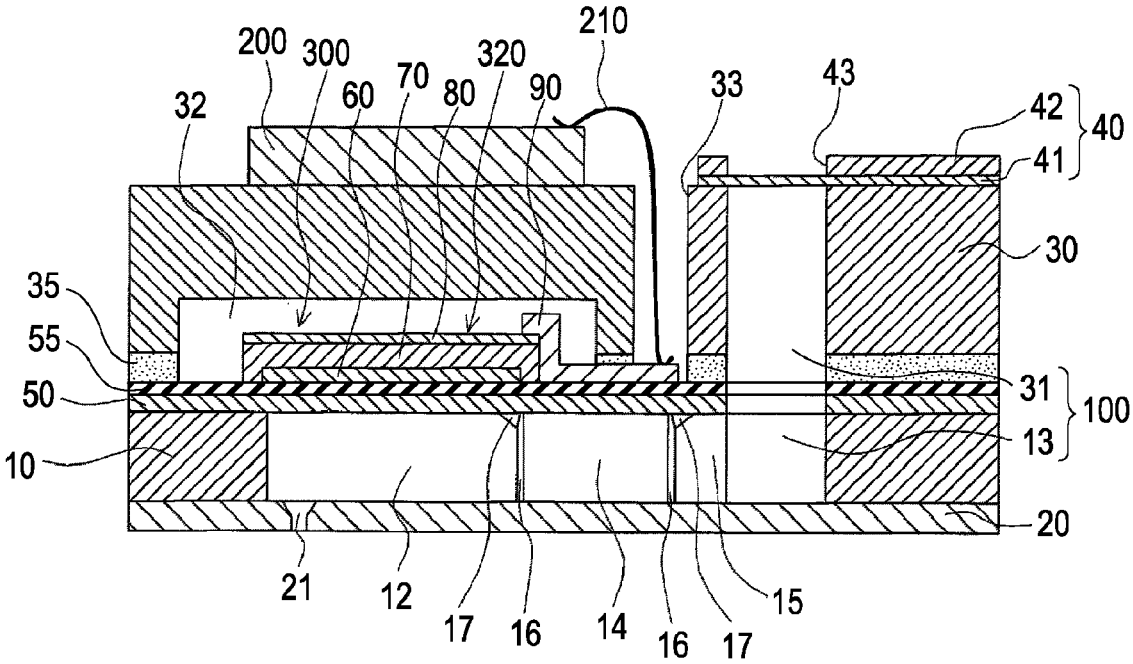
FIG. 2B is a cross-sectional view of FIG. 1.

FIG. 1 is an exploded perspective view of an ink jet type recording head as an example of a liquid ejection head according to a first embodiment of the invention, and FIG. 2A is a plan view of FIG. 1, and FIG. 2B is a cross-sectional view taken along the line A-A' in FIG. 1. As shown in the drawing, a flow-channel forming substrate 10 is formed of a silicone monocrystal substrate of a crystal plane azimuth (110) in the first embodiment, and is formed in advance with a resilient film 50 being formed of silicon dioxide and having a thickness of 0.5 to 2 μm on one surface thereof by thermal oxidation.

The flow-channel forming substrate 10 includes a plurality of pressure generating chambers 12 partitioned by a plurality of partitioning walls 11 arranged in parallel in the direction of the width (short side direction) by anisotropic etching from the side of the other surface.

The flow-channel forming substrate 10 includes ink supply channels 14 as liquid supply channels and communication channels 15 partitioned by the partitioning walls 11 at one end sides of the pressure generating chambers 12 in terms of the longitudinal direction. Formed at one end of the communication channels 15 is a communicating portion 13 which constitutes part of a reservoir 100 which corresponds to a common ink chamber (liquid chamber) of the respective pressure generating chambers 12 in communication with the reservoir portion 31 of a protective substrate 30, described later. That is, in the first embodiment, the flow-channel forming substrate 10 is provided with the pressure generating chambers 12, the communicating portion 13, the ink supply channels 14, and the communication channels 15 as liquid channels having the pressure generating chambers 12.

The ink supply channels 14 communicate with the one end sides of the pressure generating chambers 12 in terms of the longitudinal direction and each have a width smaller than that of the pressure generating chamber 12. That is, the ink supply channels 14 are formed by narrowing the flow channels of the pressure generating chamber 12 sides between the reservoir 100 and the respective pressure generating chambers 12 in the widthwise direction. The reason why the flow channels of the ink supply channels 14 are narrowed in the widthwise direction is because the ink supply channels 14 and other flow channel systems can be formed easily at once without using a mask which requires consideration of the thickness of the silicon monocrystal substrate which constitutes the flow-channel forming substrate 10 when forming the flow channel system including the pressure generating chambers 12, the communicating portion 13, and the communication channels 15 and the ink supply channels 14 simultaneously by etching.

The respective communication channels 15 are formed by extending the partitioning walls 11 on both sides of the pressure generating chambers 12 in terms of the widthwise direction toward the communicating portion 13 side for partitioning spaces between the ink supply channels 14 and the communicating portion 13. The communication channels 15 each are formed to have a width larger than that of the ink supply channel 14. In the first embodiment, the communication channels 15 are formed to have the same width as that of the pressure generating chambers 12.

Provided between the pressure generating chambers 12 and the ink supply channels 14 are stepped surfaces 16 formed by the provision of the ink supply channels 14. The stepped surfaces 16 are formed vertically with respect to one surface of the flow-channel forming substrate 10, and are inclined with respect to the short side direction of the pressure generating chambers 12. The longitudinal length of the pressure generating chambers 12 is defined by these stepped surfaces 16.

Provided at corners defined by the stepped surfaces 16, one side surfaces of the pressure generating chambers 12 on the side of the stepped surfaces 16 extending in the short side direction and the resilient film 50 which corresponds to one surfaces of the pressure generating chambers 12 in the direction of the thickness of the flow-channel forming substrate 10 are bridges 17.

The bridges 17 are provided to have a smaller height than the depth of the pressure generating chambers 12, and the surfaces thereof are inclined with respect to the stepped surfaces 16, the one side surfaces of the pressure generating chambers 12, and one side surfaces of the resilient film 50.

The surfaces of the bridges 17 may be formed into a flat surface, a curved surface, or a combination of the flat surface and the curved surface.

The bridges 17 may be formed, for example, by leaving parts of the flow-channel forming substrate 10 unetched by adjusting the etching conditions such as the concentration or the temperature of etching liquid when forming the pressure generating chambers 12, the communicating portion 13, the ink supply channels 14, and the communication channels 15 by applying anisotropic etching (wet etching) on the flow-channel forming substrate 10. That is, the bridges 17 are formed of parts of the flow-channel forming substrate 10. The bridges 17 may be formed of a material separate from the flow-channel forming substrate 10, for example, of resin or the like, as a matter of course.

In the first embodiment, the stepped surfaces 16 are formed also between the communication channels 15 and the ink supply channels 14, and the bridges 17 are formed also at corners defined by the stepped surfaces 16, the one side surfaces of the communication channels 15 in terms of the short side direction and the resilient film 50.

In this manner, with the ink supply channels 14 formed by reducing the widths of the communication channels 15 and the pressure generating chambers 12 and with the provision of the bridges 17 at the corners, when the ink from the communicating portion 13 is supplied to the pressure generating chambers 12 via the communication channels 15 and the ink supply channels 14, air bubbles entering the ink are prevented from staying at the corners and hence the interior capacities of the pressure generating chambers 12 and the communication channels 15 are prevented from changing by the stayed air bubbles which are grown up, so that the ink discharging properties may be improved.

Secured on the flow-channel forming substrate 10 on the opening surface side thereof is a nozzle plate 20 formed with nozzle openings 21 which communicate with portions near the end portions of the respective pressure generating chambers 12 on the opposite sides of the ink supply channels 14 with adhesive agent or a thermally welded film or the like. The nozzle plate 20 is formed, for example, of glass ceramics, a silicon monocrystal substrate, and stainless steel (SUS), or the like.

On the other hand, on the surface of the flow-channel forming substrate 10 opposite from the nozzle plate 20 is formed with the resilient film 50 having a thickness, for example, of about 1.0 μm, as described above, and an insulating film 55 having a thickness, for example, of about 0.4 μm is formed on the resilient film 50. In addition, a lower electrode film 60 having a thickness, for example, of about 0.2 μm, a piezoelectric substance layer 70 having a thickness, for example, of about 1.0 μm, and an upper electrode film 80 having a thickness, for example, of about 0.05 μm are laminated on the insulating film 55 through a process described later, so that a piezoelectric element 300 is configured. The piezoelectric element 300 in this specification represents a portion including the lower electrode film 60, the piezoelectric substance layer 70, and the upper electrode film 80. In general, one electrode of the piezoelectric element 300 is used as a common electrode, and the other electrode and the piezoelectric substance layer 70 are formed on each pressure generating chamber 12 by patterning. In this specification, portions configured with one of the patterned electrodes and the piezoelectric substance layer 70 and distorted piezoelectrically by the application of voltage to the both electrodes are referred to as a piezoelectric substance active portion 320. In the first embodiment, the lower electrode film 60 serves as the common electrode of the piezoelectric elements 300, and the upper electrode films 80 serve as individual electrode of the piezoelectric elements 300. However, these functions may be reversed without any problem depending on the convenience of a drive circuit or wiring. In any cases, the piezoelectric substance active portions 320 are formed respectively on the pressure generating chambers 12. In this specification, a combination of the piezoelectric elements 300 and a diaphragm which is displaced by driving the piezoelectric elements 300 is referred to as an actuator device. That is, in the first embodiment, the actuator device including the diaphragm and the piezoelectric elements 300 as pressure generating means which causes the pressure change in ink stored in the pressure generating chambers 12 is provided. Although the resilient film 50, the insulating film 55, and the lower electrode film 60 serve as the diaphragms in the example shown above, it is also possible to provide only the lower electrode film 60 without providing the resilient film 50 and the insulating film 55, and use the lower electrode film 60 as the diaphragm.

Lead electrodes 90 formed of gold (Au) or the like and extended to the ink supply channels 14 side of the flow-channel forming substrate 10 are connected respectively to the upper electrode films 80 of the respective piezoelectric elements 300. Voltage is selectively applied to the respective piezoelectric elements 300 via the lead electrodes 90.

A protective substrate 30 formed with a reservoir portion 31 at an area opposing the communicating portion 13 is joined onto the flow-channel forming substrate 10 formed with the piezoelectric elements 300 via an adhesive agent 35. The reservoir portion 31 is communicated with the communicating portion 13 of the flow-channel forming substrate 10 as described above, and configures the reservoir 100 which corresponds to a common ink chamber of the respective pressure generating chambers 12.

The protective substrate 30 is provided with a piezoelectric element holding portion 32 having a space to a degree which does not impair the movement of the piezoelectric elements 300 in the area opposing the piezoelectric element 300. The piezoelectric element holding portion 32 must simply has a space to the extent which does not impair the movement of the piezoelectric element 300, and the space may either be sealed or unsealed.

An area of the protective substrate 30 between the piezoelectric element holding portion 32 and the reservoir portion 31 is provided with a through hole 33 so as to penetrate the protective substrate in the direction of thickness, and part of the lower electrode film 60 and the distal end portions of the lead electrodes 90 are exposed in the through hole 33.

Mounted on the protective substrate 30 is a drive circuit 200 for driving the piezoelectric elements 300. The drive circuit 200 may be, for example, a circuit board, a semiconductor integrated circuit (IC), or the like. The drive circuit 200 and the lead electrodes 90 are electrically connected via a connecting wire 210 formed of a conductive wire such as a bonding wire.

The protective substrate 30 is preferably formed of a material having substantially the same coefficient of thermal expansion as the flow-channel forming substrate 10, such as glass or ceramic material. In the first embodiment, it is formed of a silicon monocrystal substrate of the plane azimuth (110), which is the same material as the flow-channel forming substrate 10.

Joined on the protective substrate 30 is a compliance substrate 40 including a sealing film 41 and a fixed plate 42. The sealing film 41 in this specification is formed of a flexible material having low rigidity (for example, polyphenylene sulfide (PPS) film of a thickness of 6 μm) and one of the surfaces of the reservoir portion 31 is sealed by the sealing film 41. The fixed plate 42 is formed of a hard material such as metal (for example, stainless steel (SUS) of a thickness of 30 μm or the like). The area of the fixed plate 42 opposing the reservoir 100 is formed into an opening portion 43 which is completely removed in the direction of the thickness, and hence the one of the surfaces of the reservoir 100 is sealed only by the flexible sealing film 41.

With the ink jet type recording head in the first embodiment, ink is taken from external ink supply means, not shown, ink is filled into the interior from the reservoir 100 to the nozzle openings 21, voltage is applied between the lower electrode films 60 and the upper electrode films 80 which correspond to the pressure generating chambers 12 respectively according to the recording signals from the drive circuit 200 to cause the resilient film 50, the insulating film 55, the lower electrode film 60, and the piezoelectric substance layer 70 to warp, so that the pressure in the respective pressure generating chambers 12 is increased and hence the ink drops are injected from the nozzle openings 21.

Second Embodiment

Figure 3:
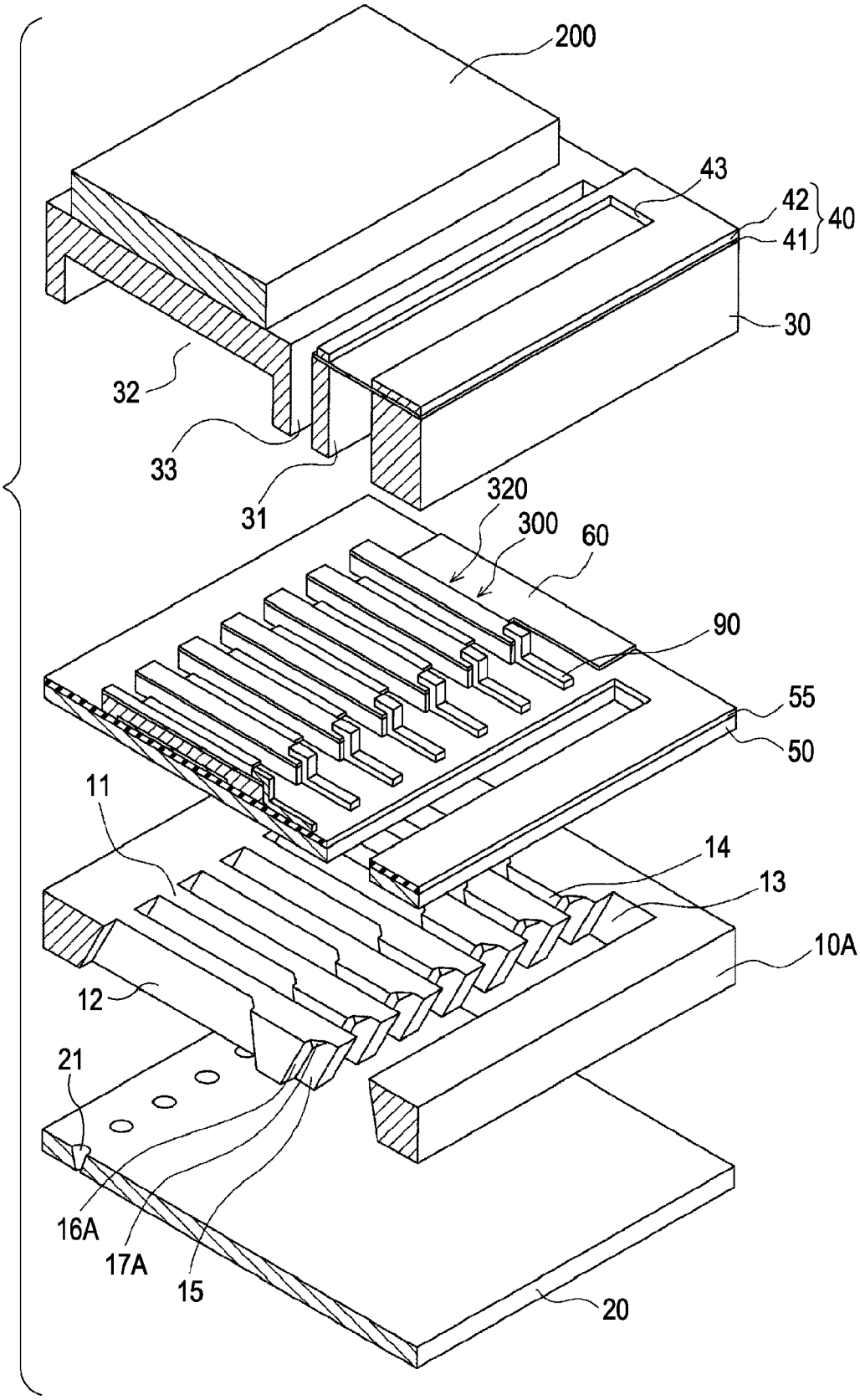
FIG. 3 is an exploded perspective view of the recording head according to a second embodiment.
Figure 4A:
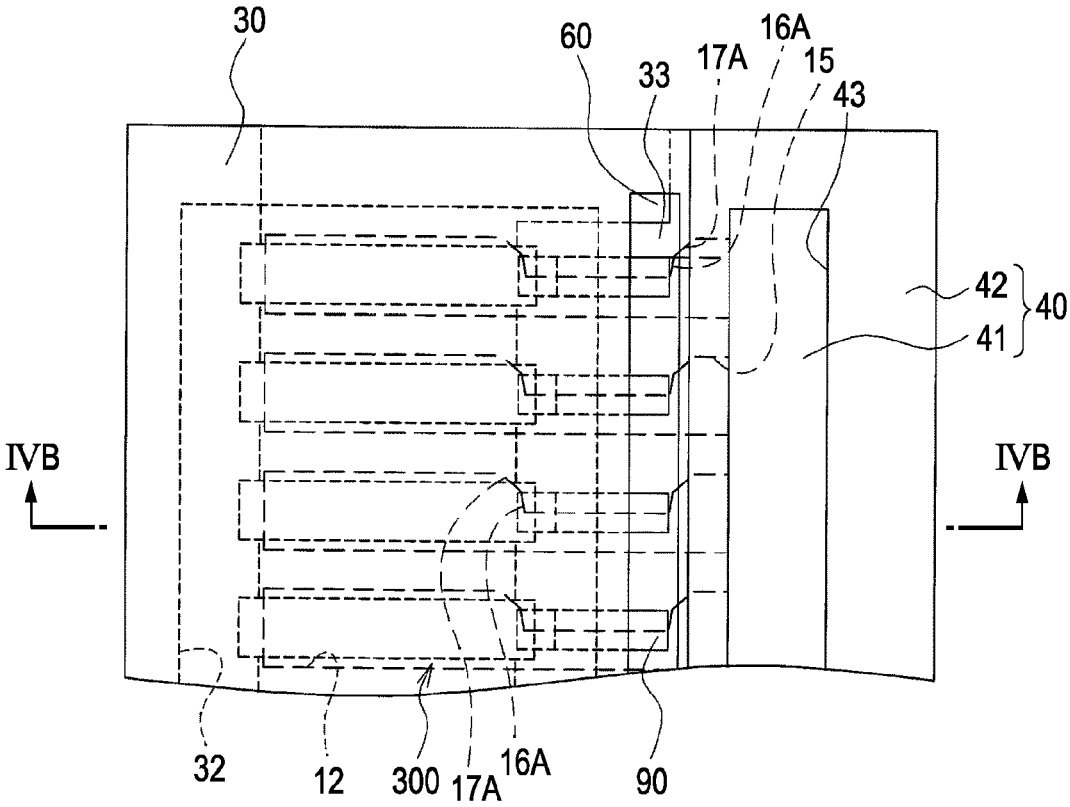
FIG. 4A is a plan view of FIG. 3.
Figure 4B:
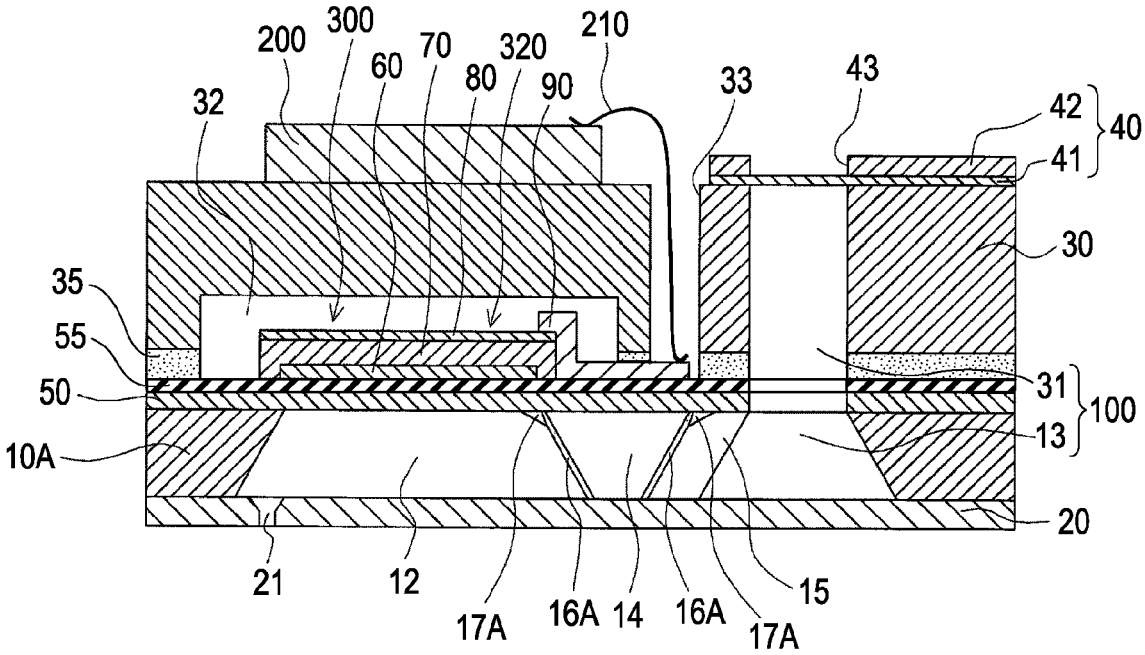
FIG. 4B is a cross-sectional view of FIG. 3.

FIG. 3 is an exploded perspective view of an ink jet type recording head showing an example of a liquid ejection head according to a second embodiment of the invention, and FIG. 4A is a plan view of FIG. 3 and FIG. 4B is a cross-sectional view taken along the line B-B' in FIG. 3. The similar members to those in the first embodiment described above are represented by the same reference numerals, and the overlapped description is omitted.

As shown in the drawing, a flow-channel forming substrate 10A which constitutes the ink jet type recording head includes the pressure generating chambers 12, the ink supply channels 14, the communication channels 15, and the communicating portion 13. Stepped surfaces 16A between the pressure generating chambers 12 and the ink supply channels 14, and between the ink supply channels 14 and the communication channels 15 are inclined with respect to the direction of depth of the pressure generating chambers 12 (the direction of thickness of the flow-channel forming substrate 10A) and is formed so as to be inclined with respect to the direction of the short side of the pressure generating chambers 12.

Bridges 17A are provided at corners defined by the stepped surfaces 16A on the pressure generating chambers 12 side, one side surface of the pressure generating chamber 12 in the short side direction on the stepped surfaces 16A side, and one of the surfaces of the resilient film 50 which defines one of the surfaces in the direction of depth of the pressure generating chambers 12.

Furthermore, the bridges 17A are also provided at corners defined by the stepped surfaces 16A on the communication channels 15 side, one side surface of the communication channels 15 on the stepped surfaces 16A in the direction of the short side, and one of the surface of the resilient film 50 which defines one of the surfaces of the communication channels 15 in the depth direction.

In this configuration as well, when the ink from the communicating portion 13 is supplied to the pressure generating chambers 12 via the communication channels 15 and the ink supply channels 14A, air bubbles entering the ink are prevented from staying at the corners and hence the interior capacities of the pressure generating chambers 12 and the communication channels 15 are prevented from changing by the stayed air bubbles which are grown up, so that the ink discharging properties may be improved.

Third Embodiment

Figure 5:
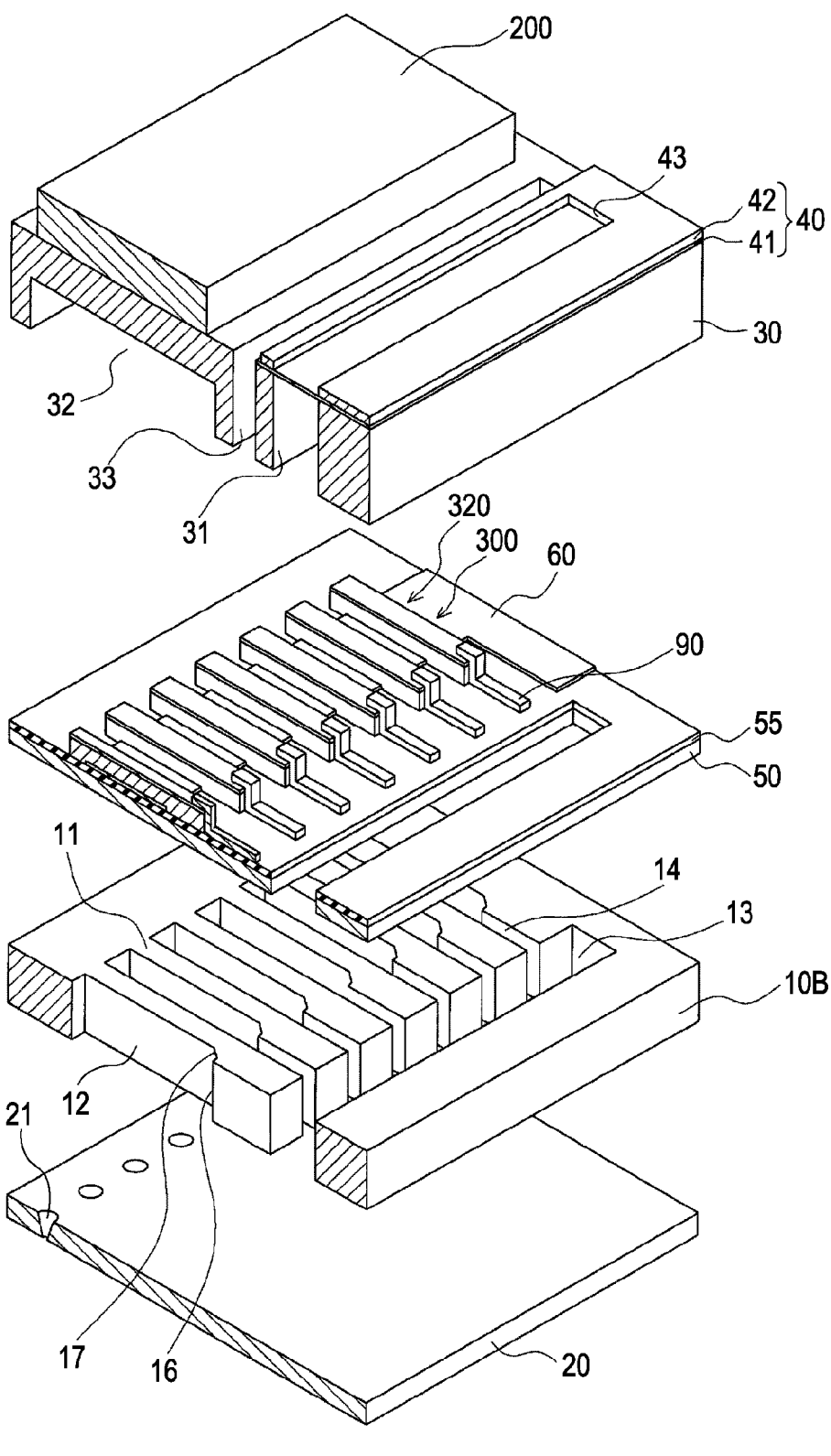
FIG. 5 is an exploded perspective view of the recording head according to a third embodiment.

FIG. 5 is an exploded perspective view of an ink jet type recording head showing an example of a liquid ejection head according to a third embodiment of the invention. The similar members to those in the above-described embodiments are represented by the same reference numerals, and the overlapped description is omitted.

As shown in FIG. 5, a flow-channel forming substrate 10B which constitutes the ink jet type recording head includes the pressure generating chambers 12, the ink supply channels 14, and the communicating portion 13, ink from the communicating portion 13 is supplied to the pressure generating chambers 12 via the ink supply channels 14.

The stepped surface 16 between the pressure generating chambers 12 and the ink supply channels 14 is formed to be vertical to the one of the surfaces of the flow-channel forming substrate 10B as in the first embodiment described above, and is inclined with respect to the direction of the short side of the pressure generating chambers 12.

The bridges 17 are provided at corners defined by the stepped surfaces 16, the one side surfaces of the pressure generating chambers 12 in the short side direction on the stepped surfaces 16 side, and one of the surfaces of the resilient film 50 which defined one of the surfaces of the pressure generating chambers 12 in the depth direction.

That is, in the third embodiment, the communication channel 15 is not provided on the flow-channel forming substrate 10B, and the bridges 17 are provided only on the pressure generating chambers 12 side.

In this configuration as well, as in the first embodiment described above, when the ink from the communicating portion 13 is supplied to the pressure generating chambers 12 via the ink supply channels 14, air bubbles entering the ink are prevented from staying at the corners and hence the interior capacities of the pressure generating chambers 12 and the communication channels 15 are prevented from changing by the stayed air bubbles which are grown up, so that the ink discharging properties may be improved.

Other Embodiment

Although some embodiments of the invention have been described thus far, the basic configuration of the invention is not limited thereto. For example, the ink supply channels 14 are configured by narrowing the width of the flow channels from one side in the first to third embodiments described above. However, the invention is not limited thereto and, for example, the ink supply channels may be narrowed from both sides thereof. When the width of the flow channels may be formed by narrowing the width from the both sides, stepped surfaces are formed on the both sides, and hence the bridges may be formed at corners defined by the stepped surfaces on both sides.

The silicon monocrystal substrate having the crystal plane azimuth (110) has been exemplified as the flow-channel forming substrate 10 in the first to third embodiments described above. However, the invention is not limited thereto and, for example, the silicon monocrystal substrate having the crystal plane azimuth (100) may be used and, alternatively, the material as a SOI substrate and glass or the like may be used.

Figure 6:
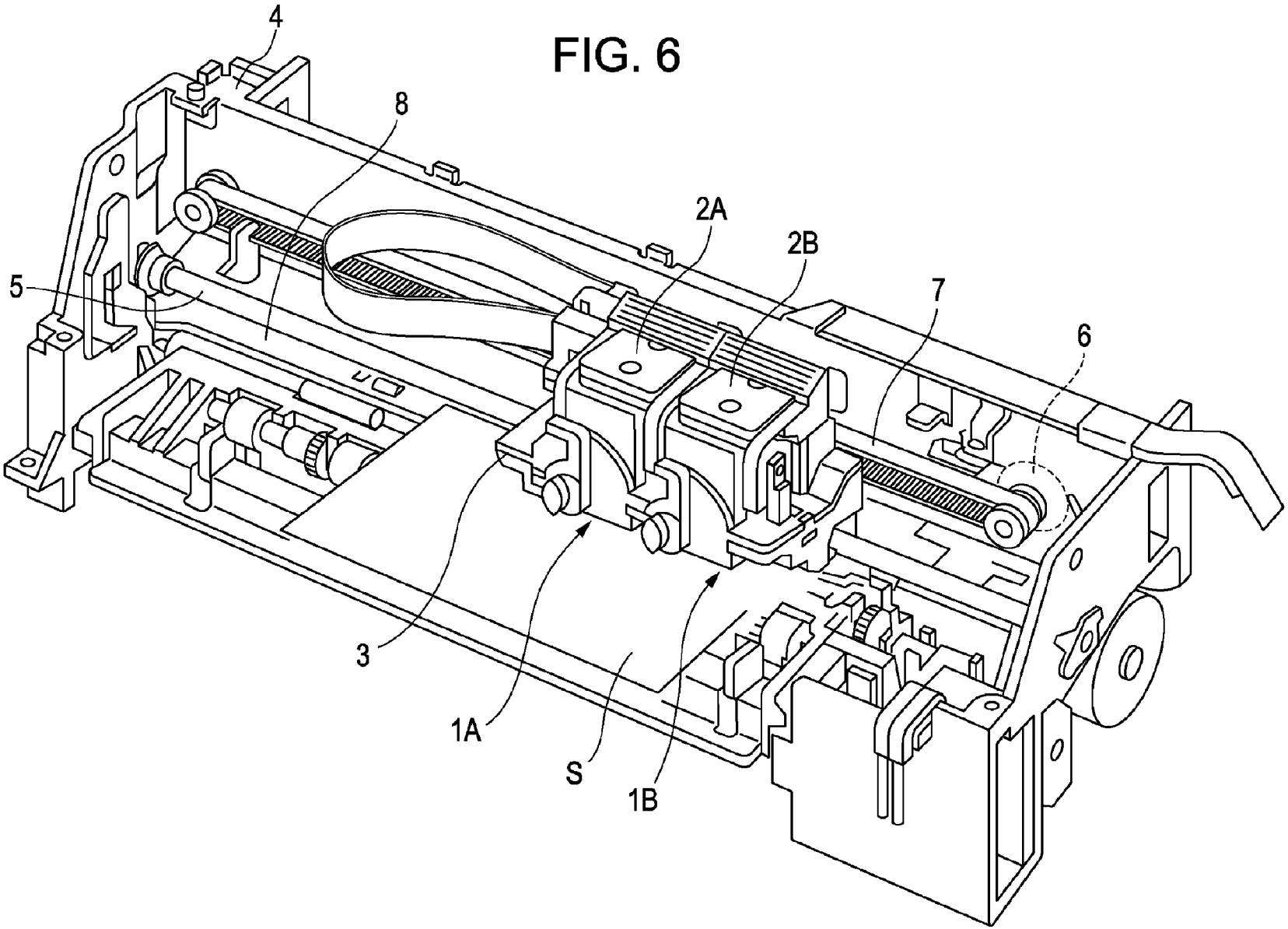
FIG. 6 is a schematic drawing showing an example of an ink jet type recording apparatus according to an embodiment.

The ink jet type recording head in the respective embodiments shown above, part of the recording head unit having the ink flow channels which communicate with an ink cartridge or the like is configured and is mounted to the ink jet type recording apparatus. FIG. 6 is a schematic drawing showing an example of the ink jet type recording apparatus.

As shown in FIG. 6, recording head units 1A and 1B having the ink jet type recording head are detachably provided with cartridges 2A and 2B which constitute ink supply means, and a carriage 3 having the recording head units 1A and 1B mounted thereon is provided on a carriage shaft 5 mounted to an apparatus body 4 so as to be movable in the axial direction. The recording head units 1A and 1B are adapted to discharge black ink composition and color ink composition, respectively.

Then, by transmitting drive force of a drive motor 6 to the carriage 3 via a plurality of gears and a timing belt 7, not shown, the carriage 3 having the recording head units 1A and 1B mounted thereon is moved along the carriage shaft 5. On the other hand, a platen 8 is provided on the apparatus body 4 along the carriage shaft 5, so that a recording sheet S as a recording medium such as paper fed by a paper feed roller or the like, not shown, is wound around the platen 8 and is carried.

In the first to third embodiments described above, the actuator device having the piezoelectric elements is used as the pressure generating means. However, it is also possible to arrange the diaphragm and electrodes at a predetermined distance and employ a so-called electrostatic actuator which controls oscillation of the diaphragm by electrostatic force as the pressure generating means. Although the ink jet type recording head has been exemplified as an example of the liquid ejection head, the invention may be applied widely to general liquid ejection heads, and may be applied to a method of manufacturing liquid ejection heads for injecting liquid other than ink as a matter of course. Other liquid ejection heads include, for example, various recording heads used in an image recording apparatus such as printers, color material injection heads used for manufacturing color filters such as liquid crystal display or the like, electrode material injection heads used for forming electrodes for organic EL displays, FED (field emission display), and so on, and biological organic substance injection heads used for manufacturing bio chips.

What is claimed is:

1. A liquid ejection head comprising:

a flow-channel forming substrate having a pressure generating chamber which communicates with nozzle openings for injecting liquid and a liquid supply channel which communicates with one end of the pressure generating chamber in terms of a first direction so as to have a first length for supplying liquid to the pressure generating chamber; and a pressure generating unit that causes the change in pressure in the pressure generating chamber, wherein the liquid supply channel is formed by narrowing the width of the pressure generating chamber in a second direction substantially perpendicular to the first direction so as to have a second length shorter than the first length, a stepped surface is formed between the side surface of the pressure generating chamber in the second direction and the side surface of the liquid supply channel in the second direction, and wherein a bridge is provided at a corner defined by the stepped surface, the side surface of the pressure generating chamber in the second direction on the stepped surface side, and one of the surfaces of the pressure generating chamber in a third direction which is orthogonal to the first direction and the second direction of the flow-channel forming substrate for bridging the corner and is comprised of the same material as the flow-channel forming substrate.

2. The liquid ejection head according to claim 1, wherein the surface of the bridge is an inclined surface inclined with respect to the stepped surface, the side surface of the pressure generating chamber in the second direction on the stepped surface side, and the one of the surfaces of the pressure generating chamber in the third direction of the flow-channel forming substrate.

3. The liquid ejection head according to claim 1, wherein the flow-channel forming substrate is provided with a communication channel having a width larger than that of the liquid supply channel in the second direction at the end of the liquid supply channel on the opposite side from the pressure generating chamber, and a stepped surface is provided between the communicating portion and the liquid supply channel, and wherein the bridge is provided at a corner defined by the stepped surface, the inner surface of the communication channel in a second direction on the stepped surface side, and one of the surfaces of the communication channel in the third direction of the flow-channel forming substrate for bridging the corner.

4. The liquid ejection head according to claim 1, wherein the pressure generating unit includes a piezoelectric element provided on the flow-channel forming substrate on the one of the surfaces thereof via a diaphragm, and the one of the surfaces of the pressure generating chamber in the flow-channel forming substrate is defined by the diaphragm.

5. The liquid ejection head according to claim 1, wherein the stepped surface is formed vertically with respect to the one of the surfaces of the flow-channel forming substrate.

6. The liquid ejection head according to claim 1, wherein the stepped surface is formed of an inclined surface inclined with respect to the third direction of the flow-channel forming substrate.

7. A liquid ejection apparatus comprising the liquid ejection head according to claim 1.

* * * * *